United States Patent [19]

Barcita

[11] 4,236,416

[45] Dec. 2, 1980

[54] POWER TRANSMISSION

[76] Inventor: Jose M. Barcita, 2809 Oakland Ave., Richmond, Va. 23228

[21] Appl. No.: 946,732

[22] Filed: Sep. 28, 1978

[51] Int. Cl.[2] ..... F16H 37/12; G05G 1/00

[52] U.S. Cl. ..... 74/52; 74/44; 74/665 K; 74/570; 74/580

[58] Field of Search ..... 74/44, 52, 570, 580, 74/664, 665 B, 665 G, 665 GE, 665 K; 123/197 R, 197 AB, 197 AC

[56] References Cited

U.S. PATENT DOCUMENTS

| | | | |
|---|---|---|---|
| 1,705,772 | 3/1929 | Kimmel | 74/570 X |
| 1,780,854 | 11/1930 | Watts et al. | 74/570 |
| 1,813,288 | 7/1931 | Groh | 74/570 X |
| 2,166,909 | 7/1939 | Kahn | 74/580 |
| 2,174,981 | 10/1939 | Kahn | 74/44 |
| 2,192,469 | 3/1940 | Green | 74/665 K |
| 2,259,176 | 10/1941 | Pitney | 74/44 |
| 2,556,110 | 6/1951 | Sanborn | 74/570 X |
| 2,725,182 | 11/1955 | Spriggs | 74/52 X |

FOREIGN PATENT DOCUMENTS

| | | | |
|---|---|---|---|
| 746565 | 8/1944 | Fed. Rep. of Germany | 74/665 R |
| 986977 | 4/1951 | France | 74/580 |
| 713819 | 8/1954 | United Kingdom | 123/197 R |

*Primary Examiner*—Lawrence J. Staab

[57] ABSTRACT

A power transmission for engines, motors, pumps and the like comprises a power shaft mounted to rotate about a fixed axis, an eccentric in the form of a tapered bar having arcuate ends secured on the power shaft to turn therewith, a power transmission ring having a circular internal bearing surface contacting the arcuate ends of the eccentric, a plurality of cranks connected to the power transmission ring by crankpins, each crank having a crankshaft journaled to turn about a fixed axis which is parallel to the power shaft. Power may be applied to any of the crankshafts by a motor coupled to the crankshaft or power may be applied to any crankpin by a pitman connecting the piston of an internal combustion engine or fluid motor to the crankpin. In either case, the power applied imparts non-rotary, planetary motion to the power transmission ring to turn the eccentric about the axis of the power shaft, thereby rotating the power shaft at the same speed at which each of the cranks is rotated but with more torque. In a modified form, the transmission ring may be provided with internal gear teeth, and through a cooperating gearing a secondary power shaft may be driven in the same or in the opposite direction relative to the primary power shaft and at a different speed.

6 Claims, 10 Drawing Figures

POWER TRANSMISSION

FIELD OF INVENTION

The invention relates to an improved power transmission for internal combustion engines and other power sources such as electric motors, fluid motors and the like.

More particularly this invention relates to a power transmission which includes a power shaft journaled to rotate about a fixed axis and having one or more eccentrics fixed thereto. Each eccentric in the form of a tapered bar having arcuate ends is encompassed by a transmission ring or strap which is driven by cranks connected to a rotating power source or by a reciprocating power source which is connected to the strap by a pitman and the crankpin of at least one of the cranks. Force applied to the transmission ring through one or more of the crankpins which are journaled to the ring imparts a non-rotary planetary motion to the ring which inturn rotates the eccentric and power shaft to which the eccentric is secured. The cranks, each journaled to the transmission ring by a crankpin, and each secured to a crankshaft which rotates about a fixed axis parallel to the power shaft, confine the motion of the transmission ring.

The following patents are representative of prior art transmissions, some of which include eccentrics:

| | |
|---|---|
| 1,595,028 Smith | Aug. 3, 1926 |
| 1,642,900 Smith | Sept. 20, 1927 |
| 1,705,772 Kimmel | Mar. 19, 1929 |
| 1,708,611 Felt | Apr. 9, 1929 |
| 1,780,854 Watts et al | Nov. 4, 1930 |
| 1,971,885 Viale | Aug. 28, 1934 |
| 2,174,981 Kahn | Oct. 3, 1939 |

In most examples of the prior art transmissions which include an eccentric, the strap or transmission ring is made in a casting with a pitman or, otherwise, the pitman is bolted down to the strap to form a unitary piece with no moving parts. The center line of the pitman is aligned with the axis of the strap and, consequently, with the axis of the circumference of the eccentric, thus confining the center line of the pitman to said axis in any degree of the revolution of the eccentric. The distance from the diametrical axis of the ring to the axis of the shaft to which the eccentric is secured determines the stroke of the piston.

The stroke of the piston of any well known engine is determined by the radius of the crankshaft so an engine with the radius of the crankshaft of the above-mentioned measurement, and without an eccentric will perform better because it does not have the friction of the eccentric. U.S. Pat. No. 1,595,098, for example, discloses a pair of in-line pistons and cylinders, each piston being connected to a pitman which has wrist action only in the pin of the piston since pitman and strap are made in one piece.

It is an object of the present invention to give independent movement to the pitman with respect to the strap by means of the crankpins of cranks which at the same time confine the strap to absolute non-rotary motion. Since the strap is controlled by means of cranks, it is easily adapted to rotary power sources or to reciprocating power sources. In both cases, the force of the crankpins is exerted to the throw of the eccentric which for longer lever action multiplied the power in the power shaft.

It is another object of the present invention to improve the support of the eccentric strap by connecting one or more cranks to the eccentric strap and distributing the cranks uniformly about the eccentric strap. The cranks are each connected to the eccentric strap by a crankpin, and each has a crankshaft which is mounted to rotate about a fixed axis parallel to a main power shaft through the eccentric disc.

It is a further object of the invention to provide a transmission for a single cylinder engine, motor, pump or the like which includes a main power shaft, an eccentric fast to the main power shaft, an eccentric strap, or transmission ring, engaging the eccentric, at least three uniformly spaced cranks connected to the transmission ring by crankpins, the cranks each having a crankshaft which rotates about a fixed axis parallel to the axis of the main power shaft, and a piston connected to the transmission ring by a pitman and reciprocable within a cylinder of the engine, motor, pump or the like. Power may be coupled to or from the crankshafts as well as coupled to or from the main power shaft. Additionally power may be coupled to or from the transmission through a secondary power shaft which is parallel with the main power shaft. The secondary power shaft has a gear fast thereto which is in driven or driving contact with the transmission ring either directly or through an intermediate gear and an internal gear secured inside the transmission ring.

It is still another object of the invention to provide a transmission for an in line multi-piston and cylinder internal combustion engine, motor, pump and the like which includes a main power shaft, an eccentric for each piston fast on the shaft, a transmission ring about each eccentric, a piston connected to each transmission ring by a pitman and crankpin, and a pair of parallel cranks journaled on opposite sides of each transmission ring by a crankpin extending through the pitman and transmission ring parallel to the powershaft, the cranks of the pair having oppositely extending, axially aligned crankshafts which are journaled in the engine housing. The cranks of adjacent pairs of cranks are interconnected by a common crankshaft, therefore all of the cranks are interconnected and rotate together about a common axis. The longitudinal axis of each engine cylinder intersects perpendicularly to the axis of the engine power shaft. The eccentrics and cranks associated with each piston and cylinder maintain their parallel relationship while they are rotating. The cranks confine the motion of each of the transmission rings to a non-rotary, planetary motion.

BRIEF DESCRIPTION OF THE DRAWING

With the foregoing more important objects and features in view and such other objects and features which may become apparent as this specification proceeds, the invention will be understood from the following description taken in conjunction with the accompanying drawing, in which like characters of reference are used to designate like parts, and in which.

DETAILED DESCRIPTION OF THE PREFERRED EMBODIMENTS

Figure 1:
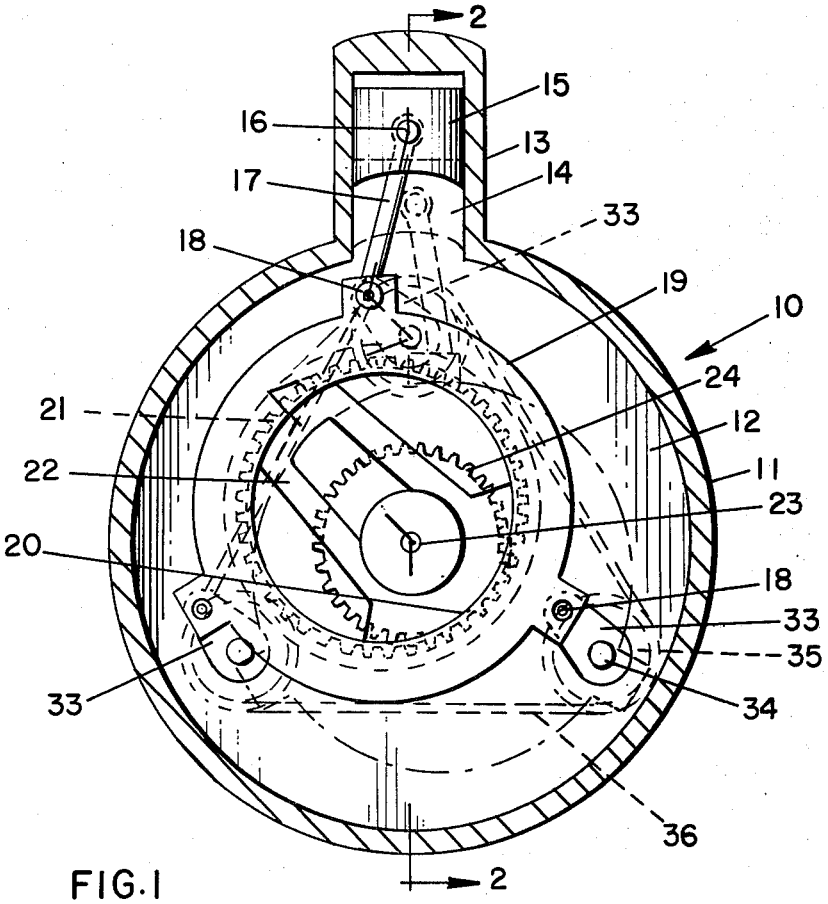
FIG. 1 is a vertical sectional view of one embodiment of the invention.
Figure 2:
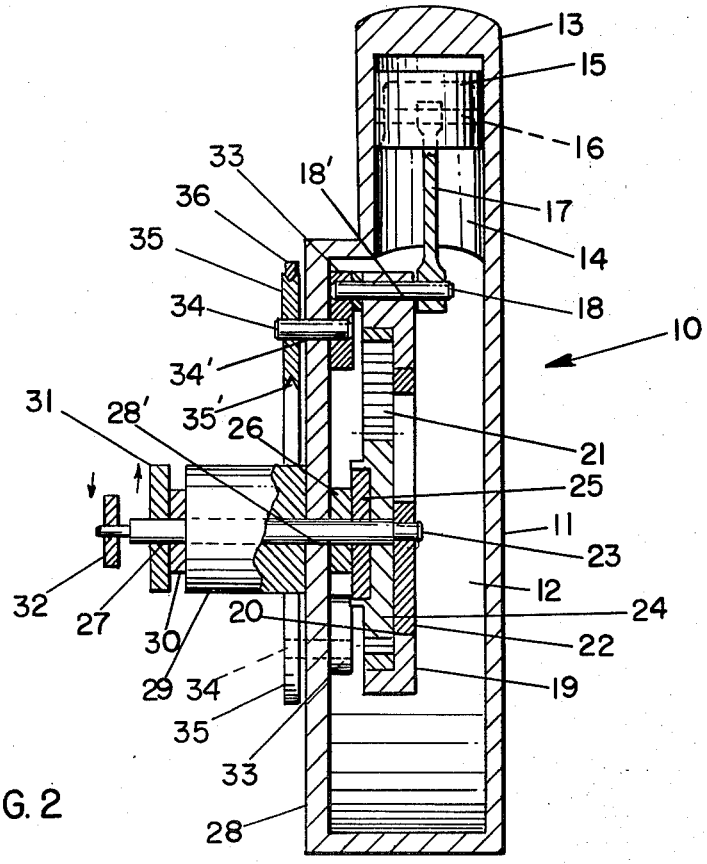
FIG. 2 is a vertical cross-sectional view taken on line 2—2 of FIG. 1.

Referring now to FIGS. 1 and 2, a power transmission 10 according to this invention is shown which comprises a hollow transmission casing 11 defining an interior cavity 12, a cylinder 13 projecting radially from the casing 11 and having a cylindrical bore 14 opening into the interior cavity 12. Slidably operating within the cylinder bore 14 is a piston 15 having a wrist pin 16 mounted transversely therein. A piston rod 17 has one end journaled on the wrist pin 16 and another end pivotally connected to an eccentric strap or transmission ring 19. The transmission ring 19 has a smooth circular internal bearing surface 20 and an internal gear ring 21 adjacent to the smooth bearing surface 20. An eccentric 22 is fitted within the circular bearing surface 20 in bearing contact therewith. The eccentric 22 is secured fast on one end of a main power shaft 23 to rotate therewith. The main power shaft 23 extends outwardly from the casing 11 through the wall 28 and is provided on the outer end with a pulley 32 fixed thereon. The main power shaft 23 is journaled in a concentric sleeve 27 which inturn is journaled in a circular opening 28′ in the wall 28 and in the cylindrical boss 29 projecting outwardly from the end wall 28. The concentric sleeve 27 is a second power shaft, having an external gear 24 fixed on its inner end in mesh with the interior gear 21 of the transmission ring, and a pulley 31 secured to its outer end. A spacer 30 is interposed between the cylindrical boss 29 and the pulley 31. Distributed uniformly around the transmission ring 19 are a plurality of cranks 33 which are connected to the transmission ring by crankpins 18. The crankpin for each crank 33 is journaled in a cylindrical bore 18′ extending through the transmission ring 19 in parallel with the axis of the main power shaft 23. Each of the crankpins are centered on a circle which is concentric with the center of the ring 19 and as shown in FIG. 1 with three cranks 33 and crankpins 18 provided, the crankpins 18 are angularly spaced 120 degrees from each other. Each of the cranks 33 is rotatably supported inside of the casing wall 28 by a crankshaft 34 which extends outwardly through a cylindrical opening 34′ in the wall and is journaled therein. The crankshafts 34 are parallel to the power shaft 23 and their centers are equally spaced radially from the axis of the power shaft 23 and equally spaced angularly from each other.

A pulley 35 is pressed or otherwise made fast to each of the crankshafts 34 outside of the casing wall 28. The pulleys 35 have a V-groove 35′ and a V-belt 36 interconnects all of the pulleys 35 and rides in the V-groove 35′ of the respective pulleys.

The power transmission shown in FIGS. 1 and 2 is adapted for converting reciprocating motion of the piston 15 in the case where the piston 15 is part of a piston and cylinder engine or fluid motor to rotary motion of the main power shaft 23, the second power shaft 27 and the crankshafts 34 and output power can be taken from the pulleys 32,31, or 35.

Where power is being applied externally to the apparatus 10, it may be applied through the pulleys 32, 31 or 35 in which case rotary motion of the pulleys will be converted to reciprocating motion of the piston 15. The pistons 15 and 16 can thus be used as a reciprocating pump or compressor. While pulleys are shown in FIGS. 1 and 2 as the means for applying external power to, or the means for taking power from the transmission 10, it is to be understood that it is within the scope of the invention to substitute sprocket wheels, gears or other rotary devices for the pulleys shown.

The cranks 33 confine the transmission ring 19 to non-rotary planetary motion about the eccentric 22.

Considering the reciprocating means comprising the piston 15 and cylinder 13 to be a one cylinder engine, the piston 15 will reciprocate, and its reciprocating motion will be converted to planetary motion of the transmission ring. As the transmission ring moves about the eccentric 22, the eccentric disc 22 is rotated and turns the main power shaft 23. The transmission ring will also move around the external gear 24 which meshes with the internal gear 21 of the transmission ring, and in so doing rotates the external gear 24. It will be noted that the external gear is separated from the end wall 28 by thrust bearing surfaces 25 and 26. Rotary motion of the external gear 24 turns the secondary power shaft 27 and the pulley 31. The external gear 24 is rotated oppositely from the direction of rotation of the eccentric disc 22 and thus the pulleys 31 and 32 are rotated oppositely.

Each full cycle of reciprocation of the piston 15 will rotate the eccentric 22 and each of the cranks one complete revolution. The external gear 24 is of one-half the diameter of the internal gear 21, and therefore it will make only one complete revolution for each two full cycles of the piston 15. The external gear 24 therefore turns the secondary output shaft 27 and its associated pulley 31 oppositely and at half of the speed of the main shaft 23 and of its associated pulley 32.

Figure 3:
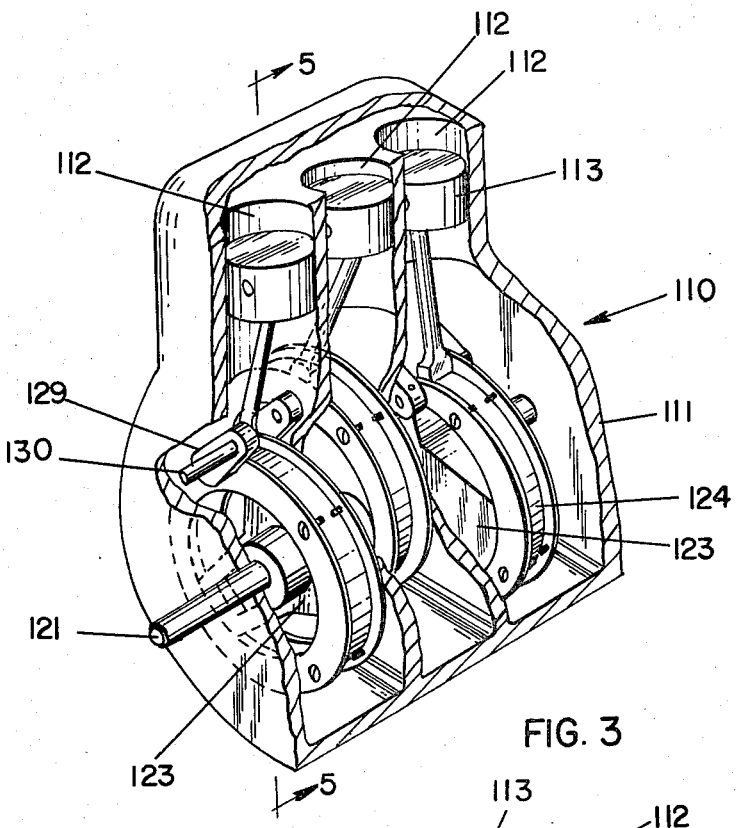
FIG. 3 is a perspective view of another embodiment of the invention with the casing broken away to show the interior parts.
Figure 4:
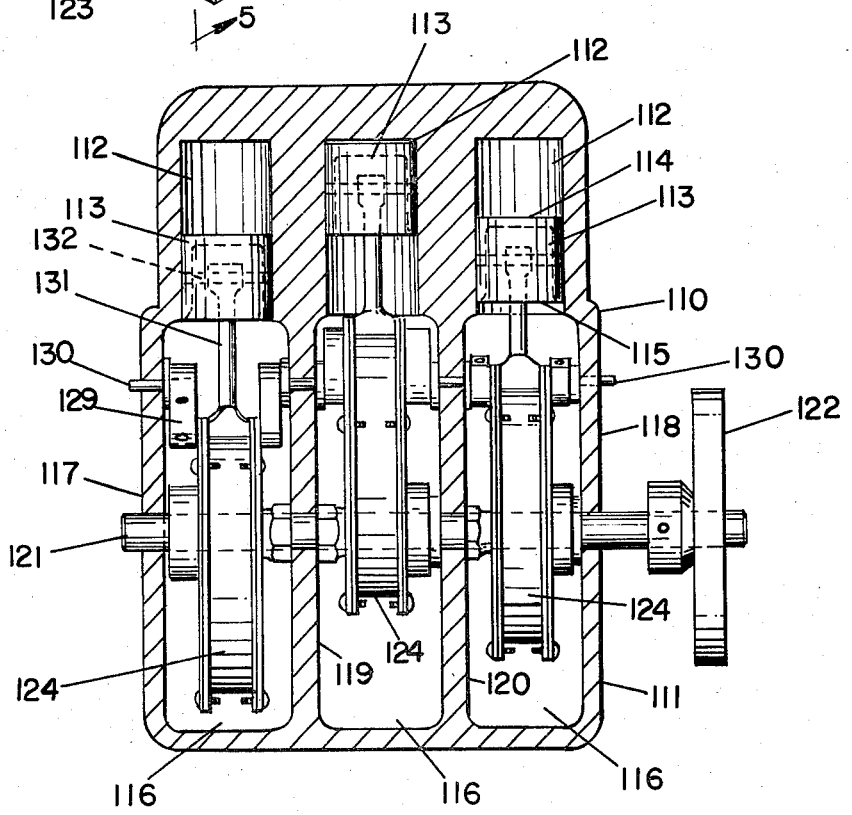
FIG. 4 is a vertical sectional view of the embodiment shown in FIG. 3 taken longitudinally of the device.
Figure 5:
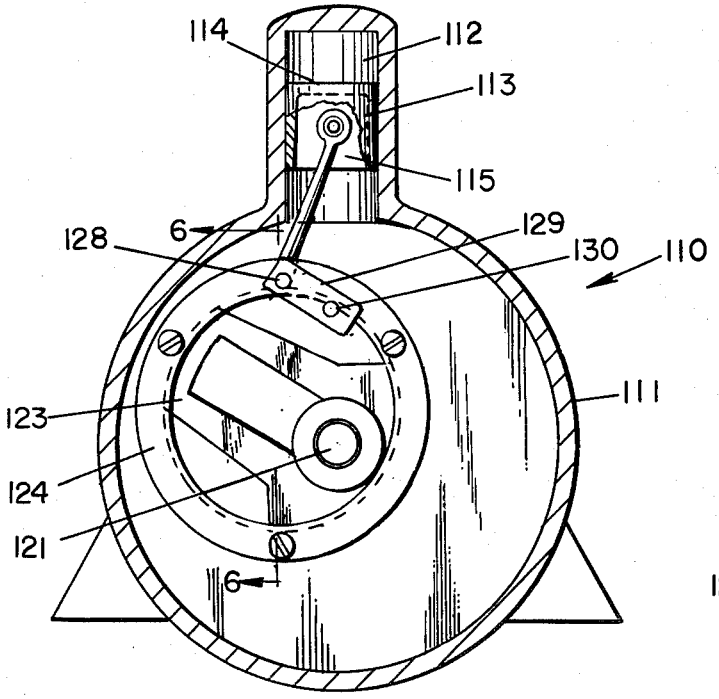
FIG. 5 is a vertical sectional view taken on line 5—5 of FIG. 3.

FIGS. 3–5 show a power transmission for a multi-cylinder in line device 110 which may be an internal combustion engine, fluid motor, fluid pump, or the like. The multi-cylinder in line device 110 includes a housing 111 in which are located multiple cylinder bores 112 arranged in line, and a piston 113 is slideably mounted in each of the cylinders 112. The transmission housing, or casing, beneath the cylinders has parallel end walls 117 and 118 and intermediate dividing walls 119 and 120.

Although not shown, it will be understood that the engine casing must be made with removable parts in a conventional manner to facilitate the assembling and adjustment of the engine components. Also the valves and other parts of the engine relating to the supply and ignition of fuel, to the exhaust of the combustion gases, and to other functions are not shown because they are conventional and are not within the scope of the invention.

Figure 6:
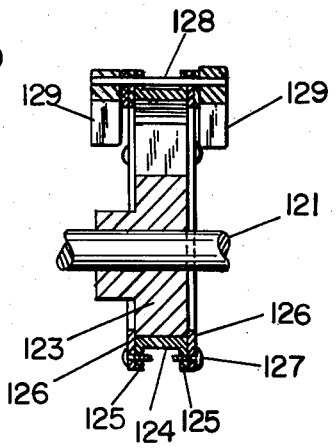
FIG. 6 is a vertical sectional view taken on line 6—6 of FIG. 5.

A linear power shaft 121 extends through the casing and is journaled in the end walls 117, 118 and intermediate walls 119 and 120. A flywheel 122 is secured to the power shaft outside of the casing 118. A plurality of eccentrics corresponding in number to the number of cylinder bores 112 are secured fast to the power shaft 121, there being one positioned in each of the cavities 116 beneath each of the cylinders 112. The eccentrics 123, each in the form of a tapered bar having arcuate ends, are secured on the shaft 121 so that each is out of phase with the next adjacent eccentric by 120° in the case of the three cylinder device shown. A strap described herein as a transmission ring 124 encompasses each eccentric 123. The rings 124 are channel-shaped in cross section for lightness (see FIG. 6), having radially outwardly extending parallel side flanges 125,125. To each side of the ring 124 is secured a thin ring-shaped plate 126 by means of bolts 127. The plates 126 have a central opening of less diameter than the internal diameter of the ring 124, and they provide radially inwardly extending side flanges to confine the ring 124 about the eccentric 123. A crankpin 128 extends through aligned openings in the flanges 125,125 of the transmission ring 124 in parallel with the axis of the ring and a pair of cranks 129,129 are secured on opposite outwardly projecting ends of the crankpin 128 in each transmission ring. Three pairs of cranks 129,129 are secured to a crankshaft 130 which is journaled in the walls 117, 118, 119 and 120 in parallel with the power shaft 121. The crank shaft 130 is made up of plural axially aligned segments or journals which extend through the walls 117, 118, 119 and 120. Each parallel pair of double cranks 129,129 is secured by a journal to the next pair to form a unitary crankshaft with three double cranks, three crankpins 128, and four journals. Each crankpin 128, with its cranks 129,129, is one hundred and twenty degrees out of phase with the other two pairs to correspond with the phase angle between the different eccentrics 123. Each pair of parallel cranks 129,129 with their crankpin 128 confine the transmission ring 124 to which they are journaled by crankpin 128 to non-rotary motion.

Each piston 113 is journaled to the transmission ring below it by means of a pitman 131. One end of the pitman 131 is journaled to the piston by means of a pin 132; the other end of the pitman 131 is journaled to the crankpin 128 between the side flanges 125,125 of the transmission ring 124.

The axis of pin 132 of each piston, the axis of the crankshaft 130 and the axis of the power shaft 121 are parallel with each other and lie in a common plane which includes the parallel longitudinal axis of the three cylinders 112. When the cranks 129,129 are turned about the axis of the crankshaft 130, by the reciprocation of the pistons 113, the ends of the pitmans 131 which are journaled to the rings 124 swing in a circular path following the circular motion of the crankpins 128. Because each crankpin 128 is journaling in wrist independence, the angle line of the pitman 131 does not follow the axis of the ring 124. The angle line that the pitman 131 makes is openly off from the shaft 121 and closer to the throw of the eccentric 123, so more force is transferred to the power shaft by longer lever action in the eccentric 123. The diameter of the cylinder 112 and the piston 113 is proportional with the stroke, and the stroke is limited by the radius of the cranks 129,129, and since the radius of the cranks 129,129 is much smaller than the radius of the eccentrics 123, no more gas is needed to apply more torque to shaft 121.

The transmission rings 124 do not turn radially in either direction, even a minute, because the other two rings, in any minute, are out of phase with the other in harmony with the phase angle of the eccentric 123 and the phase angle of the crankshaft which oppose the tendency of rotary motion of the transmission ring 124, but, they aid each other for the planetary motion which turn the eccentrics 123 to multiply the power in the power shaft 121.

Figure 10:
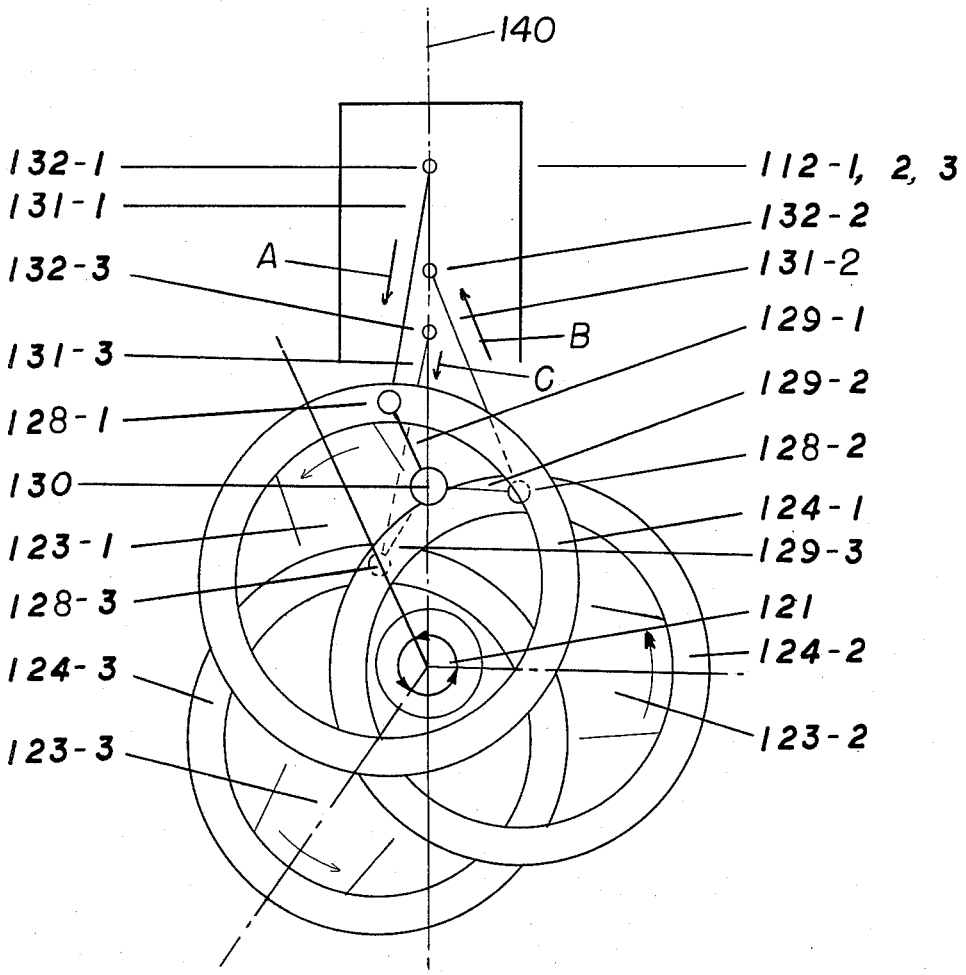
FIG. 10 is a diagramatic end view of the embodiment shown in FIGS. 3–5 showing the phase relationship of the various components associated with different cylinders of an in line, three cylinder engine.

FIG. 10 is a diagramatic view of the in line multi-cylinder engine shown in FIGS. 3–6, illustrating the relative positions of the engine and transmission components associated with the different cylinders. The reference numerals are the same as in FIGS. 3–5, but a digit has been added to indicate the order of each cylinder. For example: 131-1, 131-2 and 131-3 represent the pitmans in engine cylinders 112-1, 112-2 and 112-3 respectively.

The single cylinder 112-1, 2, 3 represents the three cylinders of the engine in line. For convenience, the pistons in the cylinders are not shown in FIG. 10, but the wrist pins 132 (1, 2 and 3) and the pitmans 131 (1, 2 and 3) are shown. As seen in FIG. 10, ignition of fuel in the cylinder 112-1 has just occurred and the pitman 131-1 is being forced down as shown by arrow A. The motion of the pitman 131-1 turns the crankpin 128-1 in a circle, and turns the crankshaft 130 by means of the pair of cranks 129-1. Power is transferred through the crankshaft 130 to the crankpins 128-2 and 128-3 by means of the pairs of cranks 129-2 and 129-3. At the same time the power applied to the crankpins 128-1, 128-2 and 128-3 is transferred to the transmission rings 124-1, 124-2 and 124-3 which transfer the power to the eccentrics 123-1, 123-2 and 123-3. The process is repeated with every ignition of fuel in the cylinders 112-1, 112-2 and 112-3.

In FIG. 10, the center line 140 represents the parallel, longitudinal axis of the bores of cylinders 112-1, 112-2 and 112-3. It will be seen that the center line 140 passes through the axis of the pins 132-1, 132-2, 132-3, the axis of the crankshaft 130 and the axis of the power shaft 121. The eccentric 123-1 leads the eccentric 123-2 by 120°, and the eccentric 123-2 leads the eccentric 123-3 by 120°, thus it will be seen that each of the eccentrics is angularly displaced from each other eccentric by 120°. Since each pair of cranks 129-1, 129-2, and 129-3 are parallel to the eccentrics 123-1, 123-2 and 123-3 respectively, they are angularly displaced from each other by 120° in the same manner as the eccentrics are angularly displaced.

The arrows A, B, and C represent the direction of motion of the pitmans 131-1, 131-2, and 131-3 at the moment just after the engine cylinder 112-1 has fired. The arrows on each of the eccentrics 123-1, 123-2 and 123-3 indicate the direction of rotation of the eccentrics.

Figure 7:
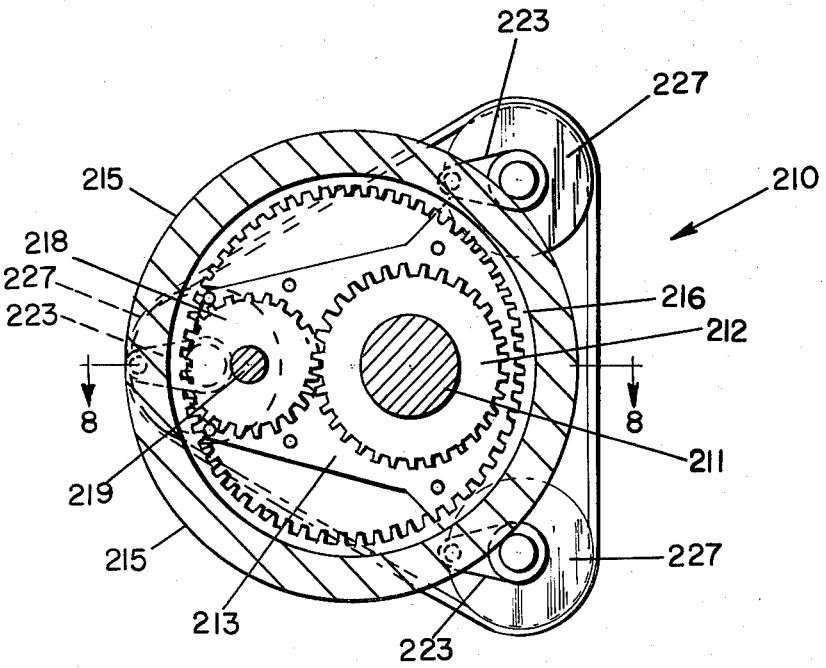
FIG. 7 is a vertical sectional view of still another embodiment of the invention.
Figure 8:
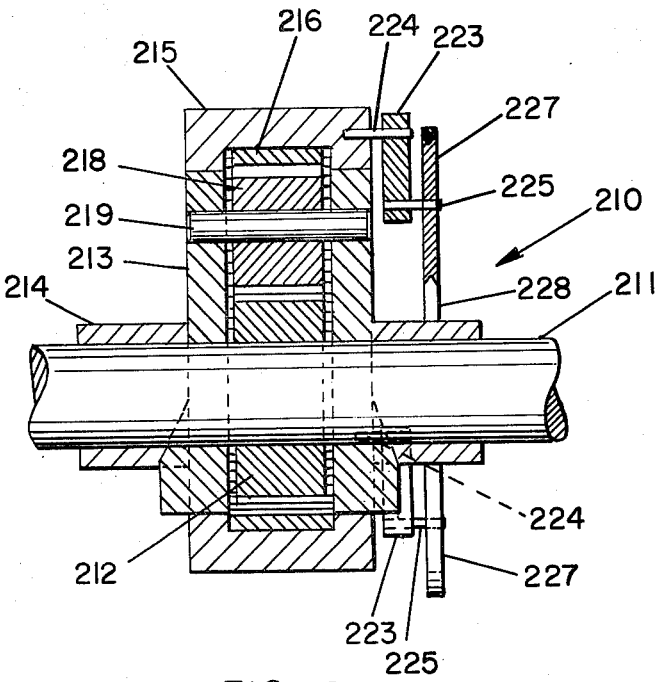
FIG. 8 is a vertical sectional view taken on line 8—8 of FIG. 7.
Figure 9:
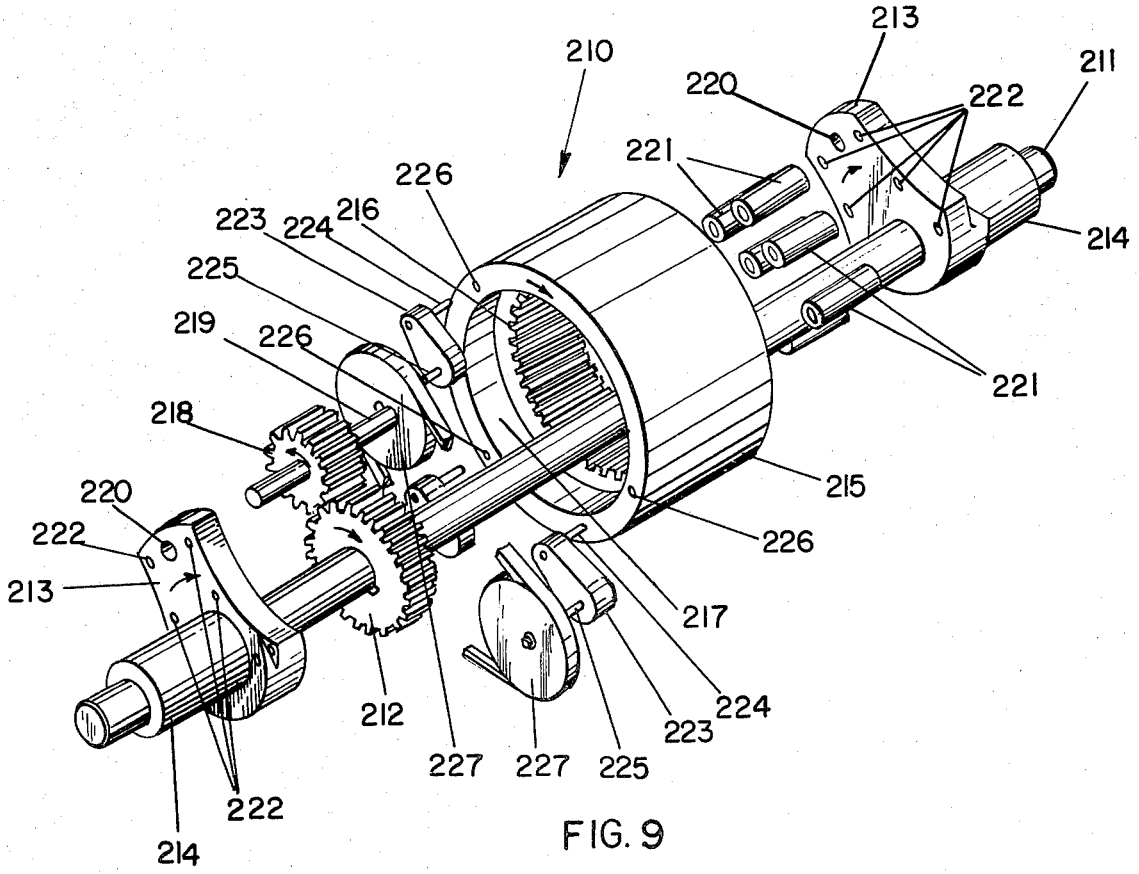
FIG. 9 is an exploded perspective view of the embodiment shown in FIGS. 7 and 8.

Another embodiment 210 of the invention is shown in FIGS. 7–9. This embodiment is a variation of the embodiment shown in FIGS. 1 and 2 which instead of having main and secondary power shafts rotating in opposite directions has main and secondary power shafts rotating in the same direction. For greater simplicity, the transmission housing and shaft bearings have not been illustrated in FIGS. 7–9. The power transmission 210 comprises an elongated power shaft 211 which is normally supported by suitable bearings (not shown) to rotate about its own longitudinal axis. A spur gear 212 is keyed to the power shaft 211 and a pair of eccentric discs 213,213 are journaled to rotate on the power shaft 211 on opposite sides of the spur gear 212. Each of the eccentric discs 213 have stub shafts 214 which are concentric with the inner power shaft 211 and which project outwardly from the eccentric disc to which it is connected in a direction opposite from the spur gear 212. An eccentric strap, or transmission ring 215 has an interior spur gear 216 mounted centrally therein and made fast to the outer ring. Within the ring 215 and on opposite sides of the interior gear 216 are smooth, circular bearing surfaces 217,217, upon which the eccentric 213,213 bear. A third spur gear 218 is keyed or otherwise made fast to a short shaft 219, whose ends project an equal distance on opposite sides of the gear 218. The ends of the shaft 219 are journaled in cylindrical bores 220 provided in the eccentric 213. A plurality of cylindrical spacers 221 are provided to space the eccentric 213 apart. Bolts, not shown, would be inserted through pairs of aligned apertures 222 in the eccentric straps 213 and one of the spacers 221 positioned between the eccentric discs. Tightening the bolts draws the two eccentric discs 213 tightly against the opposite ends of the spacers 221. The spacers 221 are of appropriate size to allow ample clearance for free rotation of the spur gears 212 and 218 between the eccentric discs 213,213.

Uniformly spaced on one side of the transmission ring 215 are three cranks 223 each having a crankpin 224 projecting from one side, and a crankshaft 225 projecting from the other side. The crankpins 224 are journaled in cylindrical bores 226 whose centers are located in a circle concentric with the transmission ring and spaced 120 degrees from the centers of adjacent bores. The crankshafts 225 would each be journaled in a bearing wall, (not shown), similar to the casing wall 28 shown in FIG. 2. On the outside of the bearing wall, as in FIG. 2, a pulley 227 is keyed or otherwise made fast to each of the crankshafts 224. The pulleys 227 are interconnected by a belt 228.

The eccentric discs 213 and the cranks 223 are all mounted with their lines of throw, (that is, a line drawn between the centers of the crankshaft and the crankpin in the case of the cranks 223, and a line drawn through the center of the shaft 211, and the center of the eccentric disc 213 in the case of the eccentric discs) in parallel and parallelism is maintained as the cranks 223 and eccentric discs 213 rotate. The ring 211 is confined to non rotary motion in such a manner that each point on the ring 211 will travel in a circular path which is different from the circular path which is traveled by every other point on the ring and a line drawn between any two points on the ring is translated. If an electric motor or other power source is coupled to any one of the three crankshafts, the three crankshafts being interconnected by the three pulleys 227 and the belt 228, will all rotate and turn the cranks 223 in the same direction. Each of the crankpins 224 will describe a separate circle, and the center of the ring 215 which coincides with the center of the eccentric disc 213 travels in a circular path about the axis of the shaft 211. The eccentric discs 213 are rotated in the same direction and at the same speed as the cranks 223 by the motion of the ring 215, thereby rotating the power shafts 214. As the eccentric discs rotate in one direction, for example clockwise as indicated by the arrow shown on the discs 213 shown in FIG. 9, the gears 218 which are in constant mesh with the internal gear 216 are caused to rotate counterclockwise, and the counterclockwise rotation of the gear 216 rotates the gear 212 clockwise.

By way of example, if the electric motor power source is 1 HP and rotates the crankshaft 225 at 1750 RPM, and the interior gear 216 has 48 teeth, the gear 218 has 16 teeth, and the gear 212 has 32 teeth, the increase in torque will be as follows:

In each revolution of the source or crankshaft 224, the gear 218 will make three revolutions at the same torque of the source. (Notice that the source is coupled to the edge of the gear 216 and not to its axis, and also that the radius of the gear 218 is approximately the same as the radius of the small cranks 223). Since the radius of the gear 218 is the same as the radius of the cranks 223, the gear 218 does not lose torque and has a speed of three times the speed of the source, or 5250 RPM. The gear 212 turns at 2625 RPM with a torque of two horsepower or 72 inch-pounds. The transmission shown in FIGS. 7–9 has two output shafts like the transmission of FIGS. 1 and 2, but they turn in the same direction at different speeds and torque.

In each of the embodiments of this invention as disclosed herein, it will be understood that the eccentric discs 22, 123 and 213 respectively are appropriately cut away for balance of the transmissions.

Although not shown, it will be understood that ball or roller bearings may be interposed between the straps and eccentrics in each of the embodiments disclosed in order to reduce friction.

With the power transmissions of this invention consisting of small crankshafts, main crankshaft, eccentrics and straps, many different engines, motors and similar devices can be made with greater force output without increasing body size.

While in the foregoing there has been described and shown a preferred embodiment of the invention, various modifications and equivalents may be resorted to within the spirit and scope of the invention as claimed.

What is claimed is:

1. A power transmission comprising a power shaft, means rotatably mounting said power shaft to rotate on a fixed axis, an eccentric secured on said power shaft to rotate therewith, a power transmission ring having a circular internal bearing surface bearing on said eccentric, said eccentric being rotatably mounted within said bearing surface, support means for confining said power transmission ring to non-rotative motion as said eccentric rotates within said power transmission ring, reciprocating means, connecting rod means interconnecting said power transmission ring and said reciprocating means for converting reciprocating motion of said reciprocating means to non-rotary planetary motion of said power transmission ring and vice-versa, said connecting rod means being pivotally connected to said reciprocating means and to said transmission ring, said support means comprising a plurality of cranks equally spaced about said power transmission ring and mounted to rotate in parallel with each other, each of said cranks having a crankpin journaled in said ring in parallel to said power shaft and a crankshaft, and bearing means rotatably supporting said crankshaft to rotate about a fixed axis which is parallel to said power shaft, and means interconnecting the crankshafts of said plurality of cranks for transmitting the force applied to one of the cranks to the other of said plurality of cranks.

2. The power transmission of claim 1 wherein said power transmission ring has an internal gear in addition to said circular bearing surface, a second power shaft mounted concentrically on said power shaft, an external gear secured on said second power shaft, said external gear being fixed on said second power shaft and meshed with said internal gear.

3. The power transmission of claim 1 wherein said reciprocating means is an internal combustion engine which applies translational motion to said power transmission ring, which in turn rotates said eccentric and turns said power shaft to provide power output thereon.

4. The power transmission of claim 1 wherein said means interconnecting the crankshafts of said plurality of cranks comprises a plurality of wheels there being a separate wheel secured on each of said crankshafts, and drive means interconnecting all of said wheels to rotate said wheels simultaneously.

5. The power transmission of claim 4 wherein each of said plurality of wheels is a pulley and said drive means interconnecting all of said wheels is a belt.

6. A power transmission comprising a power shaft, means rotatably mounting said power shaft to rotate on a fixed axis, an eccentric secured on said power shaft to rotate therewith, a power transmission ring having a circular internal bearing surface bearing on said eccentric, said eccentric being rotatably mounted within said bearing surface, support means for confining said power transmission ring to nonrotative motion as said eccentric rotates within said power transmission ring, reciprocating means, connecting rod means interconnecting said power transmission ring and said reciprocating means for converting reciprocating motion of said reciprocating means to non-rotary planetary motion of said power transmission ring and vice-versa, said support means comprising at least one crank having a crankpin journaled in said ring in parallel to said power shaft and a crankshaft, bearing means rotatably supporting said crankshaft to rotate about a fixed axis which is parallel to said powershaft, said support means comprising three of said cranks equally spaced about said power transmission ring, said cranks being mounted to rotate in parallel with each other, each of the crankshafts having a pulley fixed thereon and a belt interconnecting each of said pulleys.

* * * * *